US005876482A

United States Patent [19]

Debiesme et al.

[11] Patent Number: 5,876,482

[45] Date of Patent: Mar. 2, 1999

[54] MOULD COVER FOR CONTINUOUS CASTING OF STEEL, ESPECIALLY VERY-LOW-CARBON STEELS

[75] Inventors: Bernard Debiesme, Ghyvelde; Jean-Paul Radot, Dunkerque; Denis Coulombet, Grande Synthe; Claude Lefebvre, Dunkerque; Jean-Noël Pontoire, Guenange; Yves Roux, Abbeville; Corinne Damerval, Abbeville, all of France

[73] Assignee: Sollac and Denain-Anzin Mineraux, Pateaux and Paris, France

[21] Appl. No.: 716,430

[22] PCT Filed: Jan. 26, 1996

[86] PCT No.: PCT/FR96/00134

§ 371 Date: Sep. 20, 1996

§ 102(e) Date: Sep. 20, 1996

[87] PCT Pub. No.: WO96/22850

PCT Pub. Date: Aug. 1, 1996

[30] Foreign Application Priority Data

Jan. 27, 1995 [FR] France ..... 95.00915

[51] Int. Cl.[6] ..... C21C 7/00

[52] U.S. Cl. ..... 75/305; 75/303; 75/307; 75/328; 75/329; 148/541

[58] Field of Search ..... 75/305, 303, 307, 75/328, 329; 148/541; 164/418

[56] References Cited

U.S. PATENT DOCUMENTS 4,038,067 7/1977 Takeuchi ..... 75/257

FOREIGN PATENT DOCUMENTS 2201108A 8/1988 United Kingdom .

OTHER PUBLICATIONS

Patent Abstracts of Japan; vol. 004, no. 190 (C–037), Dec. 26, 1980 & JP–A–55128526 (Nippon Kokan KK; Others; 01), Oct. 4, 1980.

*Primary Examiner*—Patrick Ryan
*Assistant Examiner*—M. Alexandra Elve
*Attorney, Agent, or Firm*—Stevens, Davis, Miller & Mosher, L.L.P.

[57] ABSTRACT

A powder for covering an ingot mold for the continuous casting of steel, in particular steels with ultra-low carbon content. The powder comprises a base powder and particles of at least one metal nitride, its free carbon content ($\%C_{free}$) being between 0 and 1% by weight, it being produced by atomization, and having the form of granules of between 20 and 800 $\mu$m in diameter. In one application of the invention, the nitride is silicon nitride, and its weight content ($\%Si_3N_4$) is equal to: $\%Si_3N_4=0.5-0.28\times\%C_{free}\pm0.10$.

18 Claims, No Drawings

MOULD COVER FOR CONTINUOUS CASTING OF STEEL, ESPECIALLY VERY-LOW-CARBON STEELS

FIELD OF THE INVENTION

The invention relates to the continuous casting of steel. More precisely, it relates to the field of slags or cover powders which are deposited on the surface of the steel in the continuous casting mould, for the purpose of preventing the metal from being reoxidized by ambient air and being cooled by radiation, of trapping the non-metallic inclusions which have settled out, and for lubricating the walls of the mould while the cast product is being extracted.

DESCRIPTION OF THE RELATED ART

It will be recalled that these cover powders are composed of a basis powder, comprising especially oxides such as silica, lime, alumina and magnesia, and of various additives. Among these, mention may be made of sodium oxide, fluorspar, carbonates, etc. These powders are deposited on the surface of the liquid steel in the mould in order to form a layer of a few cm in depth. Near the powder/metal interface, the powder becomes liquid, enabling it to infiltrate between the wall of the mould and the solidifying skin of the cast product, and thus to perform its lubricant role. As the powder becomes consumed, it is replenished by hand or by the use of automatic devices, such as the one described in document FR 2,635,029. In this latter case, it is preferable for the powder not to have too fine a particle size, so as to reduce the risk of the pipes conveying it into the mould becoming clogged up. Thus, powders are very often used whose particles consist of hollow spheres of relatively coarse average particle size (greater than 100 $\mu$m) which are manufactured by atomization. Even if, strictly speaking, these materials can no longer really be termed pulverulent materials, they too will be designated in the rest of the text by the term "powder", as those practised in the art are wont to do.

For the purpose of reducing the rate of melting of the powder, and therefore the rapidity with which it is consumed, free carbon is mixed with its constituents, this being in the form of graphite or channel black for example. The free-carbon contents (as opposed to the combined-carbon contents included in other constituents of the powder, such as carbonates) are generally of the order of a few % by weight. It has been observed that part of this carbon passes from the powder into the liquid metal, therefore causing its carbon content to increase. In the most common cases, this increase does not impair the quality of the cast product. However, in recent years there has been a significant increase in the requirements with regard to ultra-low-carbon steels, that is to say those having carbon contents below 50 ppm, or even less. At this requirement level, the approximately 4 to 10 ppm recarburization of the liquid metal, which is usually observed when powder containing even only 1 to 2% by weight of free carbon is used, can no longer be neglected. It would therefore be highly advantageous to make available to the steelmaker cover powders which no longer lead to recarburization of the metal, or to significantly less recarburization than with the usual powders, but which would nevertheless preserve sufficiently slow melting while at the same time remaining at a reasonable cost level.

In document FR 2,314,000 it has been proposed to use powders having no free carbon, in which the latter is replaced by particles of metal nitrides, such as boron, silicon, manganese, chromium, iron, aluminium, titanium and zirconium nitrides. Preferably, the nitride content is between 2 and 10% by weight of the powder. This content must therefore be relatively high in order for such a carbon-free powder to have properties equivalent to those of the usual carbon-containing powders. However, the presence of a large quantity of nitride runs the risk of causing an appreciable uptake of nitrogen by the cast steel. Now, the applications of ultra-low-carbon steels quite often require the nitrogen content also to be kept at very low levels (less than 30 ppm, for example), and this nitrogen uptake may also be as troublesome as the carbon uptake which it was desired to avoid. Moreover, the average particle size of these powders was relatively fine, and therefore not very suitable for dispensing them automatically. Finally, nitrides are expensive compounds, the addition of which in large quantities raises the cost of the powder appreciably. For these reasons, it seems that these powders have not been the subject of extensive industrial development.

SUMMARY OF THE INVENTION

The object of the invention is to provide steel-makers, especially those casting steels having an ultra-low carbon content and possibly an ultra-low nitrogen content, cover powders which do not lead to unacceptable recarburization and renitriding of the metal, while at the same time maintaining satisfactory preservation properties and a reasonable cost.

For this purpose, the subject of the invention is a mould cover powder for continuous casting of steel, especially ultra-low-carbon steel, of the type including a basis powder and particles of at least one metal nitride, characterized in that its free-carbon content ($\%C_{free}$) lies between 0 and 1% by weight, in that it is manufactured by atomization and in that it is in the form of granules of diameter lying between 20 and 800 $\mu$m.

According to one embodiment of the invention, the said nitride is silicon nitride and its weight content ($\%Si_3N_4$) is equal to:

$$\%Si_3N_4=0.5-0.28\times\%C_{free}\pm0.10$$

As will be understood, the invention consists in using, as a compound for controlling the rate of melting of the powder, no longer carbon alone or a nitride alone at high contents, but a mixture of carbon and one or more metal nitrides, especially silicon nitride, or possibly one or more nitrides alone but always at relatively low contents. This is made possible by the fact that the powder is manufactured by an atomization process.

DETAILED DESCRIPTION OF THE PREFERRED EMBODIMENT

The invention will be better understood on reading the following description.

One of the essential conditions for a cover powder to be able to perform its role satisfactorily is that the particles which control its rate of melting be uniformly distributed therein. The inventors have discovered that, using the powders according to the prior art containing nitrides but no carbon, which are manufactured by conventional processes, such as compacting, pelletizing, grinding or extrusion, and which had a relatively fine particle size (300 $\mu$m at most, and generally 45 $\mu$m on average), this uniformity could not be guaranteed. It was then necessary to compensate for its deficiencies by an addition of nitrides greater than would have been necessary in theory. In this way it was certain that any fraction of the powder would have a nitride content sufficient for it to provide its at least acceptable rate of melting. Having discovered this, it was necessary to find a means of guaranteeing satisfactory uniformity of the powder, by virtue of which means it would be conceivable to decrease the amounts of nitrides to be introduced. The inventors thus realized that the process of manufacturing the powder by atomization would allow the desired result to be achieved.

The principle of this process, applied to the powders according to the invention, is as follows. Firstly, the principal raw materials of the powder are weighed and dry-mixed. Next, the mixture is introduced into a vessel for dispersion with a certain percentage of water and of atomization assistants in order to form a pulp called a slip. The nitrides and optionally the free carbon involved in the composition of the powder according to the invention are added at this stage, together with the atomization assistants. This slip is introduced into a transfer vessel and then pulverized in an atomizing tower by a high-pressure pump. The mist thus obtained is dried in a stream of air at 600° C. and the pulverized droplets become granules around which the carbon and nitride particles are uniformly distributed.

The various operating parameters of the installation, coupled with the intrinsic characteristics of the slip, make it possible to control the particle size of the powder. In the case of the invention, the average diameter of the granules must preferably be of the order of from 300 to 500 μm and, in order to form the powder intended to be added to the mould, only granules having a diameter lying between 20 and 800 μm will be employed. Another advantage of this atomization production is that the granules, because of their size, are perfectly suited to being added to the mould by means of automatic devices.

The excellent uniformity of the distribution of the nitrides, which ensure that the powder has the desired rate of melting, has the consequence that, for the same performance, a smaller nitride addition is necessary than in the powders of the prior art. It is thus possible, for an acceptable additional cost, to completely dispense with adding free carbon, which, as was stated, it is desirable to reduce as far as possible when the powder is intended for the casting of ultra-low-carbon steels. In order to find the best possible compromise between the various technical and economic requirements (knowing that the risk of renitriding the liquid metal and the cost of the powder increase with the content of nitrides), it is usually chosen not to completely dispense with adding free carbon, and to substitute it only partly with an addition of nitrides, in a quantity sufficient to maintain the rate of melting of the powder at the desired value. In this regard, the maximum permissible free-carbon content may be fixed at 1% by weight.

The metal nitrides which can be used by themselves or as a mixture in the powders according to the invention are essentially boron nitride BN, silicon nitride $Si_3N_4$, aluminium nitride AlN, titanium nitride TiN, manganese nitride MnN, zirconium nitride ZrN, iron nitride $Fe_4N$ and chromium nitride $Cr_2N$. However, it would seem that, from among these compounds, it is silicon nitride which overall has the most favourable properties in terms of cost and performance. In particular, its metallic element passing into the liquid steel during the decomposition of the powder has, in most of the cases where it is used, only an insignificant metallurgical influence, something which would not always be the case, for example for boron nitride.

In the case where silicon nitride is used, the weight content of the powder of this element, "$\%Si_3N_4$", should obey the following relationship, "$\%C_{free}$" designating the free-carbon content:

$$\%Si_3N_4=0.5-0.28\%C_{free}\pm0.10$$

By way of example, mention may be made of the case of a cover powder which has, in weight per cent, the following composition (the balance to 100% consisting of volatile materials):

$SiO_2$: 33.5%±2.5

$CaO_{total}$: 31.5±2.5

$Al_2O_3$: 4.8%±1.5

F: 7.2%±1.7

$Na_2O$: 11.9%±2.0

MgO: 1.2%±1.0

$C_{free}$: 0.60% in the form of channel black $Si_3N_4$: 0.35%

The silicon nitride particles added to the other components of the powder preferably have an average diameter less than or equal to 5 μm and a specific surface area of from 2.5 to 3.5 $g/m^2$.

These additions of carbon and silicon nitride give the powder a rate of melting of approximately 5 mg/s (measured at 1300° C. in a tube furnace in a controlled oxidizing atmosphere), i.e. equivalent to that which would be exhibited by a conventional reference powder, which would consist of 1.8% of free carbon and no silicon nitride and would in other respects have a composition identical to the powder according to the invention which has just been described.

With this reference powder, recarburization of the liquid steel of the order of from 4 to 8 ppm is observed. With the powder according to the invention which has just been described, the maximum recarburization observed does not exceed 4 ppm and is often below the limits of analytical accuracy. Moreover, no significant renitriding of the steel is observed with this powder according to the invention, nor any silicon uptake either.

Of course, the application of these cover powders according to the invention is in no way limited to the casting of ultra-low-carbon steel: they can be used for casting other types of steels. Likewise, without departing from the spirit of the invention, it is possible to add to the powder other components intended to fulfil particular functions, such as reducing agents (aluminium, silicocalcium, etc.), insofar as their presence does not unfavourably affect the lubricating ability of the powder.

We claim:

1. A mold cover powder for continuous casting of steel, the mold cover powder comprising:

a basis powder; and particles of at least one metal nitride; wherein:

the mold cover powder has a free-carbon content ($\%C_{free}$) between 0 and 1% by weight; and the mold cover powder is in a form of granules of diameter lying between 20 and 800 μm.

2. A mold cover powder according to claim 1, wherein an average diameter of the granules lies between 300 and 500 μm.

3. A mold cover powder according to claim 1, wherein the nitride is selected from a group consisting of boron, silicon, aluminum, titanium, manganese, zirconium, iron and chromium nitrides.

4. A mold cover powder according to claim 3, wherein the nitride is silicon nitride having a weight content ($\%Si_3N_4$) equal to:

$$\%Si_3N_4=0.5-0.28\times\%C_{free}\pm0.10.$$

5. A mold cover powder according to claim 1, wherein the metal nitride particles have an average diameter less than or equal to 5 $\mu$m and a specific surface area of from 2.5 to 3.5 g/m$^2$.

6. A mold cover powder according to claim 2, wherein the nitride is selected from a group consisting of boron, silicon, aluminum, titanium, manganese, zirconium, iron and chromium nitrides.

7. A mold cover powder according to claim 6, wherein the nitride is silicon nitride having a weight content ($\%Si_3N_4$) equal to:

$$\%Si_3N_4=0.5-0.28\times\%C_{free}\pm0.10.$$

8. A mold cover powder according to claim 2, wherein the metal nitride particles have an average diameter less than or equal to 5 $\mu$m and a specific surface area of from 2.5 to 3.5 g/m$^2$.

9. A mold cover powder according to claim 3, wherein the metal nitride particles have an average diameter less than or equal to 5 $\mu$m and a specific surface area of from 2.5 to 3.5 g/m$^2$.

10. A mold cover powder according to claim 4, wherein the metal nitride particles have an average diameter less than or equal to 5 $\mu$m and a specific surface area of from 2.5 to 3.5 g/m$^2$.

11. A mold cover powder according to claim 6, wherein the metal nitride particles have an average diameter less than or equal to 5 $\mu$m and a specific surface area of from 2.5 to 3.5 /m$^2$.

12. A mold cover powder according to claim 7, wherein the metal nitride particles have an average diameter less than or equal to 5 $\mu$m and a specific surface area of from 2.5 to 3.5 g/m$^2$.

13. A method of making a mold cover powder, the mold cover powder comprising a basis powder and particles of at least one metal nitride and having a free-carbon content ($\%C_{free}$) between 0 and 1% by weight, the method comprising:

(a) forming a slip comprising (i) raw materials for the basis powder, (ii) the at least one metal nitride and (iii) water;

(b) atomizing the slip to form a mist; and (c) drying the mist to form granules having diameters lying between 20 $\mu$m and 800 $\mu$m.

14. A method according to claim 13, wherein step (c) comprises drying the mist in a stream of air at 600° C.

15. A method according to claim 13, wherein the granules have an average diameter between 300 and 500 $\mu$m.

16. A method according to claim 13, wherein the nitride is selected from a group consisting of boron, silicon, aluminum, titanium, manganese, zirconium, iron and chromium nitrides.

17. A method according to claim 16, wherein the nitride is silicon nitride having a weight content ($\%Si_3N_4$) equal to:

$$\%Si_3N_4=0.5-0.28\times\%C_{free}\pm0.10.$$

18. A method according to claim 1, wherein the metal nitride particles have an average diameter less than or equal to 5 $\mu$m and a specific surface area of from 2.5 to 3.5 g/m$^2$.

* * * * *

UNITED STATES PATENT AND TRADEMARK OFFICE

CERTIFICATE OF CORRECTION

PATENT NO. : 5,876,482

DATED : March 2, 1999

INVENTOR(S) : Bernard DEBIESME, et al.

It is certified that error appears in the above-identified patent and that said Letters Patent is hereby corrected as shown below:

It is certifed that a printing error appears in the above-identified patent with respect to the issuance of non-elected claims 13-18 and that said Letters Patent are hereby corrected as shown below:

Column 6, lines 1-31, cancel all of claims 13-18.

Signed and Sealed this

Sixteenth Day of January, 2001

*Attest:*

*Attesting Officer*

Q. TODD DICKINSON

*Commissioner of Patents and Trademarks*